US006363831B2

(12) United States Patent
Gussalli Beretta

(10) Patent No.: US 6,363,831 B2
(45) Date of Patent: Apr. 2, 2002

(54) DEVICE FOR LOCKING A TILTING BARREL OF A PISTOL

(76) Inventor: Ugo Gussalli Beretta, Via Tosio 6, I-25121 Brescia (IT)

( * ) Notice: Subject to any disclaimer, the term of this patent is extended or adjusted under 35 U.S.C. 154(b) by 0 days.

(21) Appl. No.: 09/834,215

(22) Filed: Apr. 11, 2001

Related U.S. Application Data

(63) Continuation of application No. PCT/IT00/00267, filed on Jun. 28, 2000.

(51) Int. Cl.[7] ..... F41A 5/00
(52) U.S. Cl. ..... 89/163; 89/173; 89/176
(58) Field of Search ..... 42/75.04, 8, 14, 42/44, 75.02; 89/163, 173, 174, 176, 162

(56) References Cited

U.S. PATENT DOCUMENTS 2,846,925 A * 8/1958 Norman ..... 89/145
5,309,815 A * 5/1994 Moller et al. ..... 89/163
5,415,075 A * 5/1995 Moon ..... 89/163
5,433,134 A * 7/1995 Leiter ..... 89/14.5
5,581,046 A * 12/1996 Weldle et al. ..... 89/196
5,675,106 A * 10/1997 Leiter ..... 89/14.5

FOREIGN PATENT DOCUMENTS

DE 3313-630 A * 4/1983
GB 2137322 * 3/1984 ..... F41C/5/00

* cited by examiner

*Primary Examiner*—Michael J. Carone
*Assistant Examiner*—Gabriel S Sukman
(74) *Attorney, Agent, or Firm*—McGlew and Tuttle, P.C.

(57) ABSTRACT

This invention concerns a closing device for the barrel in semiautomatic and automatic pistols. The barrel (22) is equipped, in its lower rear part, with first lateral means (31) for interacting with the first complementary devices (28) at the sides of the breech-block (21) to hold the barrel closed when the breech-block is in the forward position, and with second means (32) designed to interact with the second complementary means (25) on an element (23) of the stock, for swinging the rear part of the barrel downward and the blocking of the barrel in order to open the gun when the breech-block is moved into the rear position.

5 Claims, 5 Drawing Sheets

DEVICE FOR LOCKING A TILTING BARREL OF A PISTOL

This application is a continuation of PCT/IT00/00267 filed Jun. 28, 2000.

This invention concerns semiautomatic and automatic pistols of the type with an oscillating barrel and, in particular, refers to a device for closing the barrel in said pistols and the blocking/unblocking of this device by means of the breech-block carriage.

In some well-known versions of the oscillating barrel pistols, the barrel is held closed by means of a barrel-breech block coupling, which occurs in the upper part of the breech-block. In this case, the barrel is equipped on top with a projection or step which, when the barrel is closed, rests against a shoulder made in an upper transverse wall of the breech-block and which is released from said shoulder, to open the barrel, when the breech-block recoils after each shot and the barrel, which follows it for a stretch and is constrained by runners on the gun stock, swings downwards from the breech.

This method of closing the barrel is relatively simple. However, it requires the breech-block to have a bridge integrated into its upper part, near to the cartridge chamber. Therefore, the breech-block has a rather "closed" structure, with an ejection hole for cases of limited length, also because it is difficult to effect the coupling closure too far forward.

This construction, in particular the narrowness of the breech-block opening, may hinder the safe and correct ejection of the cases when the ammunition is fired.

In another well-known version, the oscillating barrel is held in the closed position in the lower part of the barrel and breech-block. This has the advantage of making the breech-block more "open" in the upper part, to ensure the ejection of the case without hindrance, but, on the other hand, there is the disadvantage that the closure is done by means of an additional device, which is movable, awkward and relatively complicated.

It is the aim of this invention to propose a closing device for oscillating barrel pistols, which operates on the lower part of the barrel and the breech-block, incorporating within it the advantages of a simple construction and an "open" breech-block, typical of the above-mentioned models, without resorting to movable, complicated and expensive components.

In fact, one of the advantages is that the means of closure are integral with the barrel, and the upper part of the breech-block remains completely free of blocking duties, so it may be opened wide to freely release the used cartridge case while the breech-block retreats.

The aim and the advantages whereof above are achieved by using a closing device for pistols with an oscillating barrel, according to claim 1.

Further details of the invention will become clear from the following description, made with reference to the enclosed drawings, in which.

In said drawings, showing a pistol that incorporates the device of the invention, the stock 20, the breech-block carriage 21 and the barrel 22 are all highlighted.

Figure 1:
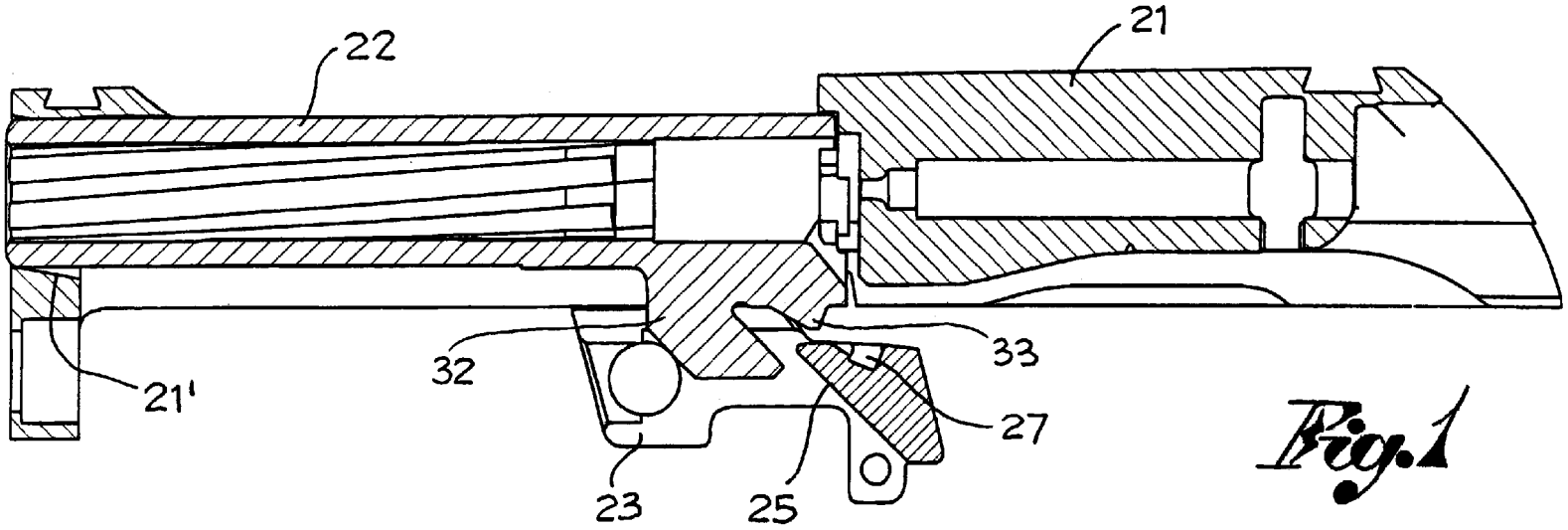
FIG. 1 shows part of a pistol in lengthwise cross-section, with the barrel closed.
Figure 4:
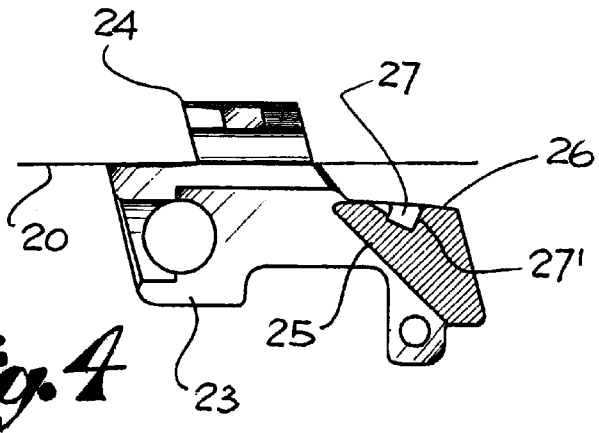
FIG. 4 shows a cross-section of the insert according to the arrows IV—IV in FIG. 3.
Figure 3:
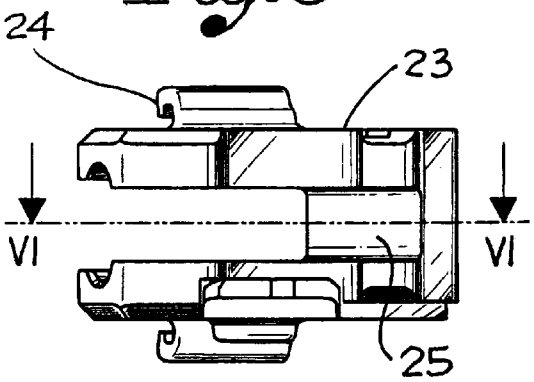
FIG. 3 shows a view from below of the insert in FIG. 2.
Figure 2:
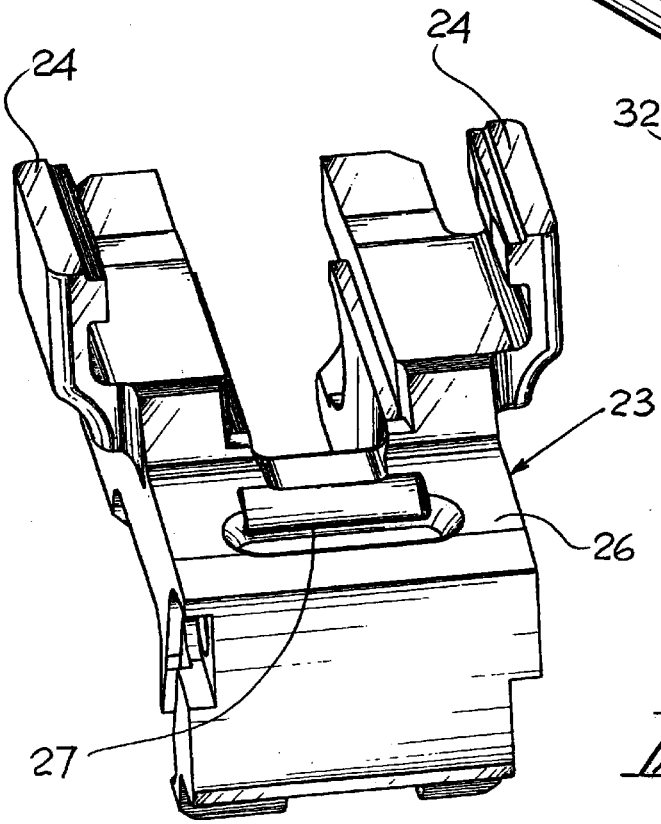
FIG. 2 shows a perspective of the front insert of the stock.
Figure 6:
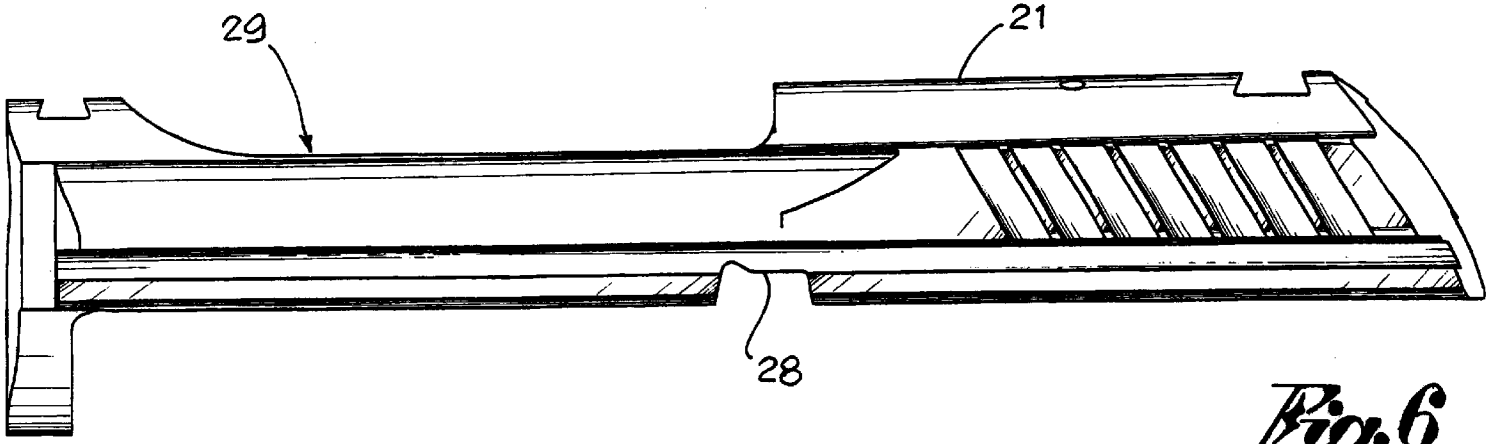
FIG. 6 shows a side view of the breech-block in FIG. 5.
Figure 7:
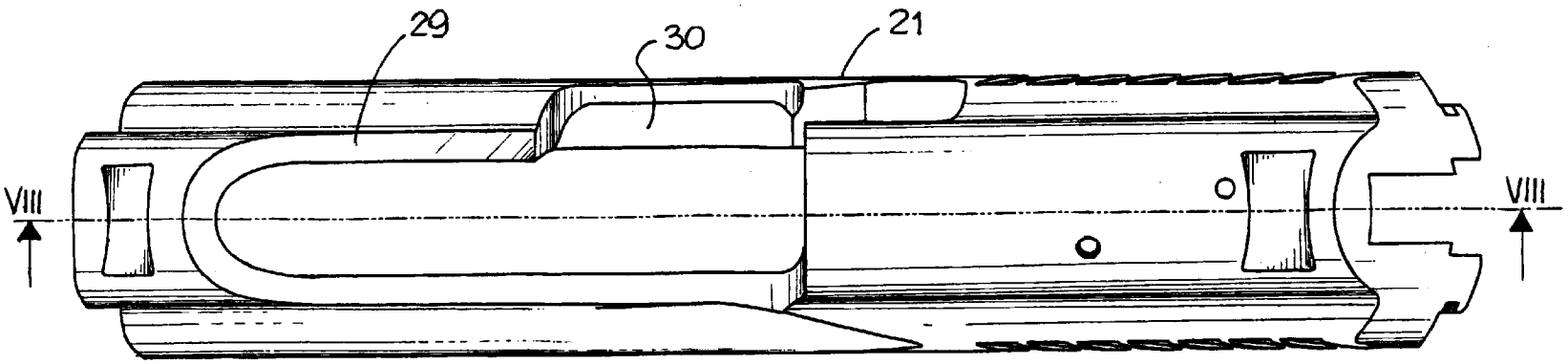
FIG. 7 shows a view of the breech-block from above.
Figure 8:
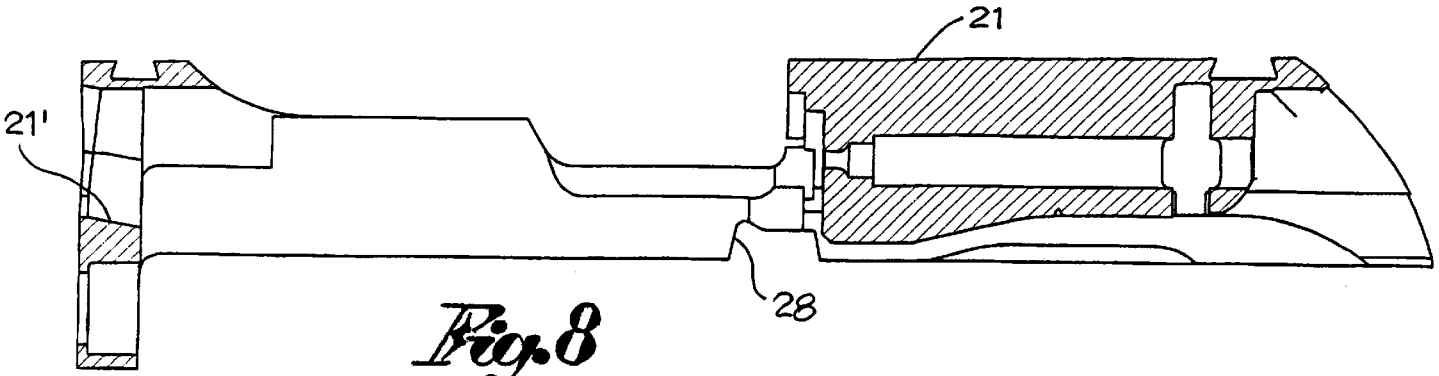
FIG. 8 shows a lengthwise cross-section of the breech-block according to the arrows VIII—VIII in FIG. 7.

In the front section, the stock 20 is equipped with an opening and closing element for the barrel. This element may be integrated with the stock, or, as shown in the drawings, may consist of an insert 23—FIG. 2—with two parallel side aims 24, turned upwards, between which the breech-block carriage 21 is guided lengthwise. Furthermore, beneath the plane of movement of the breech-block 21, the element or insert 23 has an opening slider 25, which slopes from front to back of the gun, and which has an end piece 26 with a notch 27 on its upper surface and behind the slider. It should be noted that the notch 27 has a back wall 27' which is at an angle to the vertical, facing in the opposite direction to that of the slider 25—FIG. 4.

The breech-block, guided along the stock between the two arms 24 of the insert, moves in the usual way between a forward closed position of the gun, for shooting, and a rear open position of the gun, for ejecting the spent cartridge case and re-arming the gun with new ammunition.

The forward position is guaranteed by a spring (not shown), while the rear open position is caused by the firing of the ammunition or by moving the breech-block manually.

Figure 5:
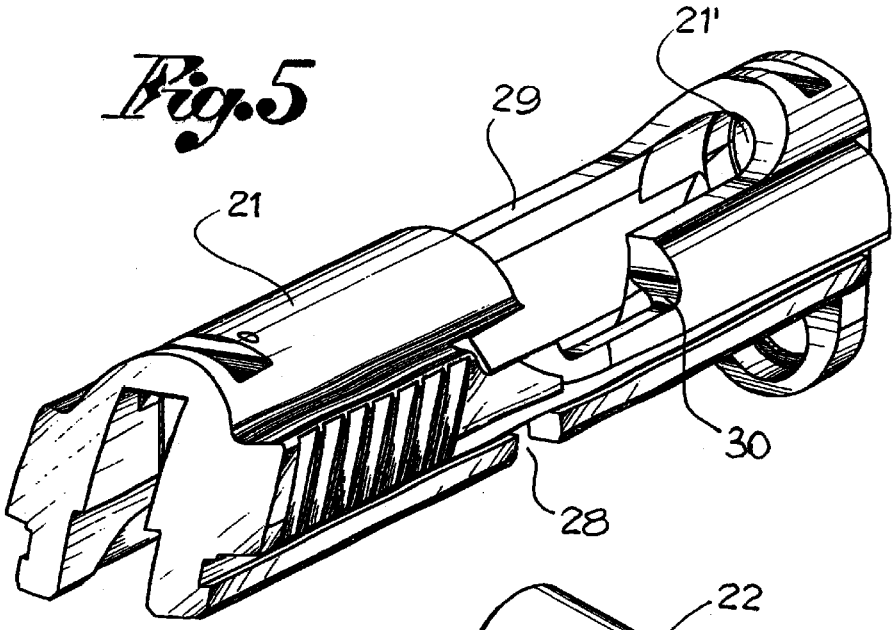
FIG. 5 shows a perspective of the breech-block from the side of the passage for ejecting the case.

The breech-block 21 sits astride the barrel 22 and has, down below and on opposite sides, two blocking notches 28 and, above, a large lengthwise opening 29 with a lateral passage 30 for ejecting the spent cartridge case—FIG. 5.

The lower part of the barrel 22 is guided into a tunnel 21' in the front of the breech block. The barrel is subject to oscillation between a horizontal closed position and a position sloped downwards at the back, when open. It assumes a horizontal position when the gun is closed, and the sloped open position when the gun is open, with the breech-block drawn back.

Figure 9:
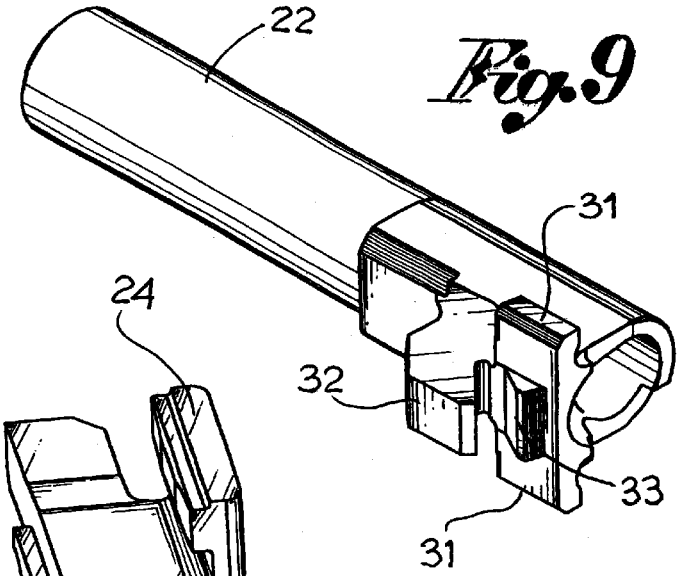
FIG. 9 shows a perspective of the barrel from below.
Figure 11:
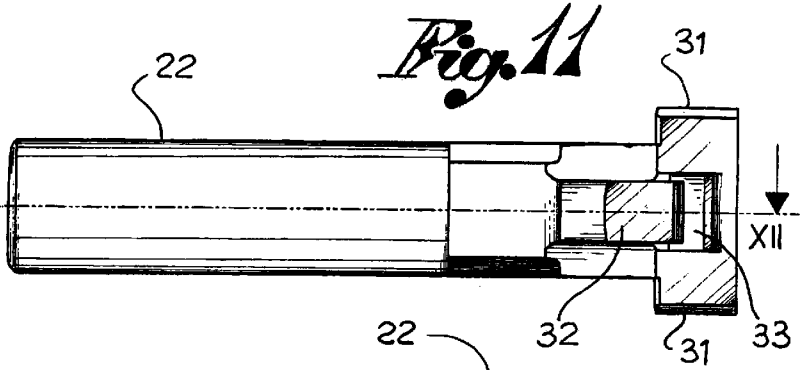
FIG. 11 shows a view of the barrel from below.
Figure 13:
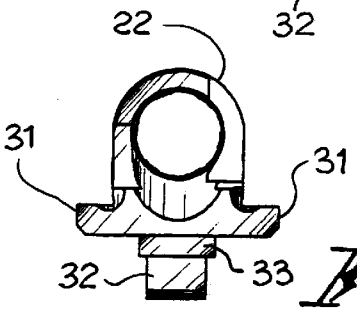
FIG. 13 shows a view of the barrel from its rear end.
Figure 10:
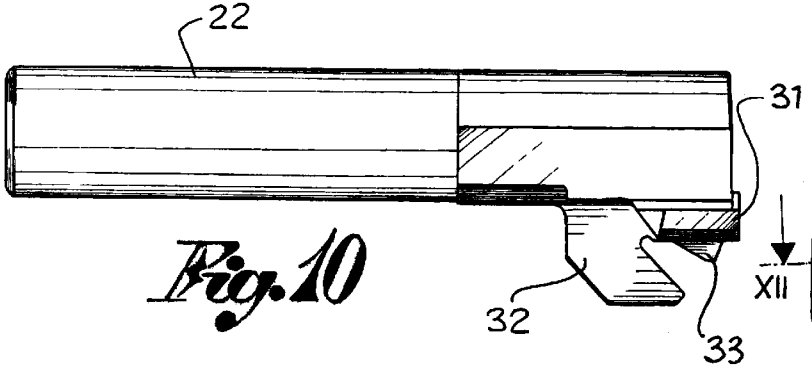
FIG. 10 shows a side view of the barrel in FIG. 9.
Figure 12:
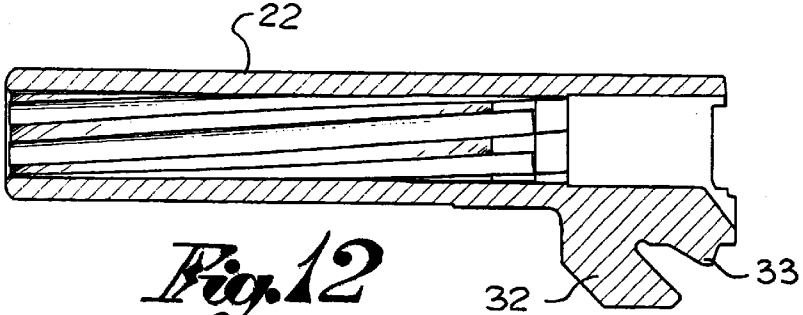
FIG. 12 shows a lengthwise cross-section of the barrel according to the arrows XII—XII in FIG. 11.

The barrel has two lateral fins 31 on either side—FIGS. 9, 11, 13—and, beneath and centrally, a wedge-shaped tenon 32 and a catch 33. The lateral fins 31 are designed to interact with the lateral cavities in the breech-block, while the opening tenon 32 and the catch 33 are designed to interact with the slider 25 and the notch 27, respectively, on the front element or insert 23 of the stock 20.

Figure 14:
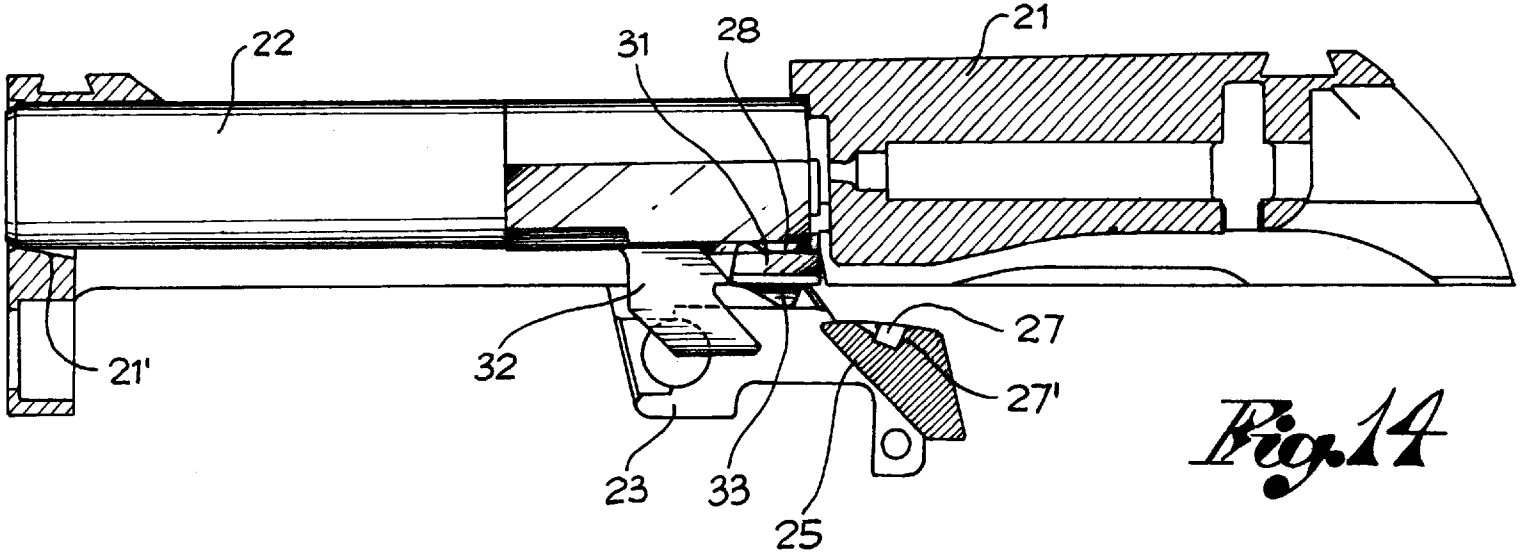
FIGS. 14 and 15 show the whole: insert, breech-block and barrel, at two moments of the opening.

More precisely, the lateral fins 31 on the barrel fit into the lateral cavities 28 of the breech-block 21 when the latter is in the forward position, thereby blocking the barrel in the horizontal closed position. In this condition, the gun is ready to fire the ammunition in the barrel and, furthermore, the opening tenon 32 and the catch 33 are up front, far away from the slider 25 and the notch 27, respectively—FIG. 14.

Figure 15:
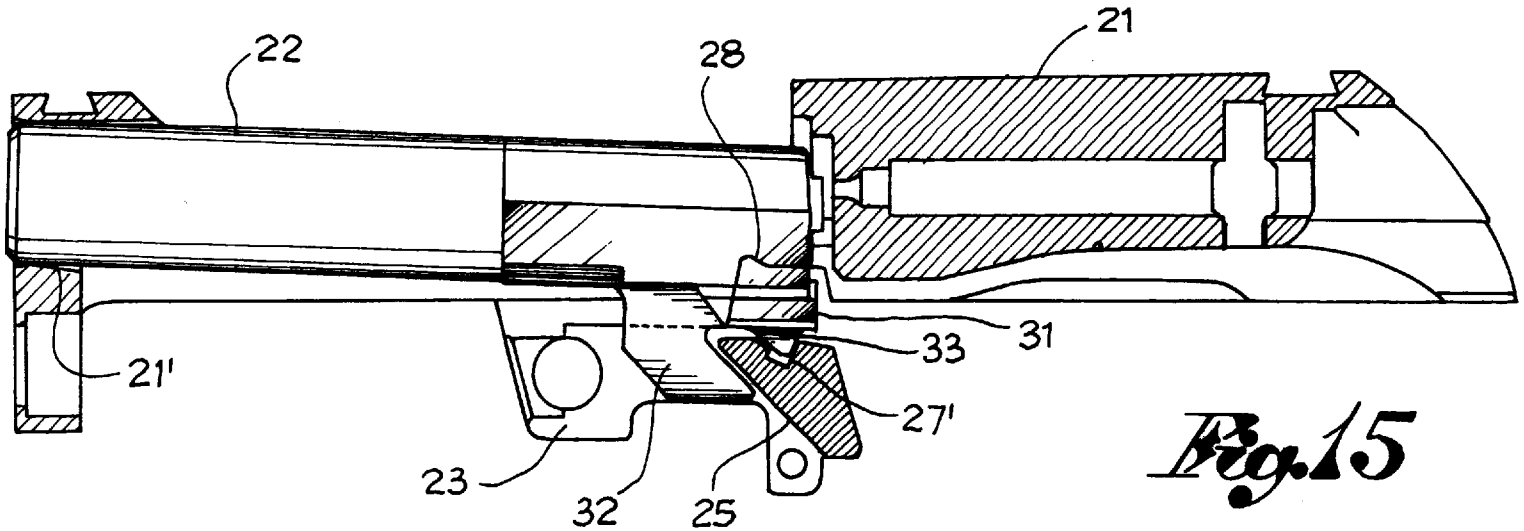

Once the ammunition has been fired, the breech-block slides backwards. During the first part of this backward movement, the breech-block pulls with it the barrel, which is held by means of the lateral fins 31. This continues until the opening tenon 32 is intercepted by the slider 25 on the insert 23—FIG. 15. Then, the interaction of the tenon and the slider forces the rear of the barrel to slope downwards, causing the lateral fins to be freed from the lateral cavities on the breech block, while the latter continues its backward movement. In this way, the cartridge chamber opens and the spent cartridge case is ejected.

In addition, the barrel is firmly blocked with the help of the catch 33. When the barrel is sloping backwards, the catch 33, in fact, snags against the face 27' of the notch 27. Given the inclination of this face 27' of the notch, the barrel undergoes a small forward movement, causing the tenon 32 to detach slightly from the slider 25, so that there is no interference between these two parts when the barrel slopes even more as the breech block is completely drawn back, the barrel tilting upward at the front, with its fulcrum in the said notch 27.

Then, with the return of the breech block to its forward position, the barrel resumes its horizontal position, forced to close by the push forward from the breech-block and blocked there by the lateral fins, which settle back into the lateral cavities.

What is claimed:

1. A device for closing the barrel of semiautomatic and automatic pistols, the device comprising:

a stock with an opening and closing element in a front part;

a breech-block carriage guided along said closing element and movable axially, between a forward closed position and a rear open position, a first complementary means associated with the breech-block carriage at either side of the breech-block and a second complementary means located on said closing element;

a spring placed between said stock and said breech-block carriage in order to push said breech-block carriage into the forward position, the return movement being carried out manually or following the firing of the gun; and a barrel guided lengthwise and fitting with a front part of said breech-block carriage, said barrel being subject to oscillations between a horizontal closed position, when said breech-block carriage is in the forward position, and a sloping downward open position, when the breech-block carriage is in the rear position, said barrel having a first lateral means, in its lower rear part, which interacts with said first complementary means of the breech-block carriage to block the barrel in the closed position when said breech-block carriage is in the forward position, and a second means interacting with said second complementary means for the oscillation and the unblocking of the barrel in order to open it when the breech-block carriage is moved backwards.

2. A device according to claim 1, wherein said first means of the barrel comprises at least one lateral fin and said first complementary means of the breech-block carriage comprises at least one lateral cavity into which said fin enters from below, when the breech-block carriage is in the forward position and the barrel is closed.

3. A device according to claim 1, wherein said second means of said barrel, comprises a wedge-shaped tenon and said second complementary means on the closing element of the stock comprises an opening slider for the barrel oscillation and the release of the lateral fin of the barrel from the breech-block cavity, during the first part of the movement of the breech-block from the forward to the rear position.

4. A device according to claim 3, wherein said second means of the barrel also comprises of a catch in the rear of said wedge-shaped tenon and said second complementary means on the closing element of the stock also include a notch with a rear wall that slopes in the opposite direction to said slider, said catch blocking against s sloping side of said notch when the barrel oscillates downwards and backwards, causing the tenon to detach slightly from the slider, allowing, however, the front of the barrel to oscillate upwards following the final reverse movement of the breech-block carriage.

5. A device according to claim 1, wherein said first means of the barrel comprises two fins, on opposite sides and said first complementary means of said breech-block carriage comprises two lateral cavities in which said fins insert themselves upwards, when the breech-block carriage is in the forward position and the barrel closed; said second means of said barrel comprises a wedge-shaped tenon and said second complementary means on said closing element of the stock comprises an opening slider sloping downwards towards the rear of the gun, the wedge shaped tenon interacting with said slider for the oscillation of the barrel and the release of the lateral fins of the barrel from the cavities on the breech-block during the first phase of the breech-block movement backwards from the forward position; said second means of the barrel also comprising a catch at the back of said wedge-shaped tenon, and said second complementary means on the insert of the stock also including a notch which has a back wall that slopes in the opposite direction to said slider, said catch interacting with said sloping wall of said slider when the barrel is oscillated downwards and backwards in order to detach the tenon slightly from the slider, allowing the front of the barrel to oscillate upwards as a result of the final backward movement of the breech-block carriage.

* * * * *